United States Patent [19]

Stearns et al.

[11] Patent Number: 4,861,015

[45] Date of Patent: Aug. 29, 1989

[54] SHEET ACCUMULATING APPARATUS

[75] Inventors: Floyd E. Stearns, Warsaw; Jeffery A. Pitas, Fairport; Robert D. LeRoy, Rochester; Roger E. Ditzel, Corfu, all of N.Y.

[73] Assignee: Eastman Kodak Company, Rochester, N.Y.

[21] Appl. No.: 196,887

[22] Filed: May 20, 1988

Related U.S. Application Data

[63] Continuation of Ser. No. 943,469, Dec. 19, 1986, abandoned.

[51] Int. Cl.[4] ..... B65H 31/04

[52] U.S. Cl. ..... 271/213; 271/220; 271/241

[58] Field of Search ..... 271/207, 213, 220, 181, 271/177, 226, 241, 245, 163, 306, 180; 414/54, 62, 63, 36, 789.1, 789.2

[56] References Cited

U.S. PATENT DOCUMENTS

| | | | |
|---|---|---|---|
| 3,739,925 | 6/1973 | Martin | 271/220 |
| 4,084,809 | 4/1978 | Looney | 271/220 |
| 4,087,087 | 5/1978 | Looney | 271/220 |
| 4,248,413 | 2/1981 | Fox | 270/53 |
| 4,354,787 | 10/1982 | Gensike et al. | 271/213 X |
| 4,428,574 | 1/1984 | Kataoka | 271/307 |
| 4,500,085 | 2/1985 | Rayfield | 271/207 |

OTHER PUBLICATIONS

IBM Technical Disclosure Bulletin, vol. 17, No. 8, Jan. 1975, p. 2255, "Sheet Stacking Technique", D. F. Manning et al.

Xerox Disclosure Jorunal, vol. 3, No. 1, Jan./Feb. 1978, p. 47, "Compliant Scuffer", James Britt.

*Primary Examiner*—Joseph J. Rolla
*Assistant Examiner*—David H. Bollinger
*Attorney, Agent, or Firm*—Lawrence P. Kessler

[57] ABSTRACT

An apparatus for receiving sheets traveling seriatem along a path, and accumulating such sheets in a stack justified along one marginal edge thereof. The apparatus includes a tray into which sheets are directed, one after another, from the sheet travel path for accumulating such sheets into a stack on the tray. A striker plate is associated with one marginal edge of the tray. The accumulated sheets are continuously urged into engagement with the striker plate to justify one margin of the accumulated sheet stack. The mechanism for urging the sheets into engagement with the striker plate is supported relative to the striker plate on the opposite side from the sheet travel path and extending over the tray, and under the influenece of gravitational forces follows the level of the topmost sheet in the stack.

2 Claims, 5 Drawing Sheets

FIG. 9
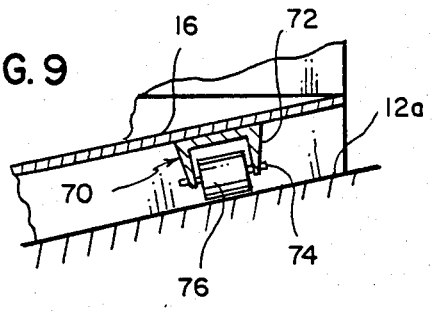
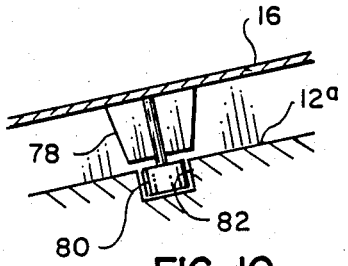
FIG. 10
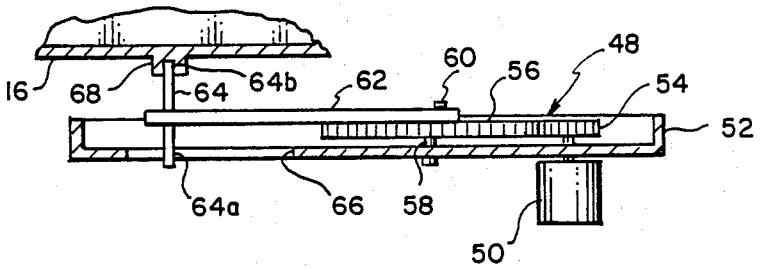
FIG. 8
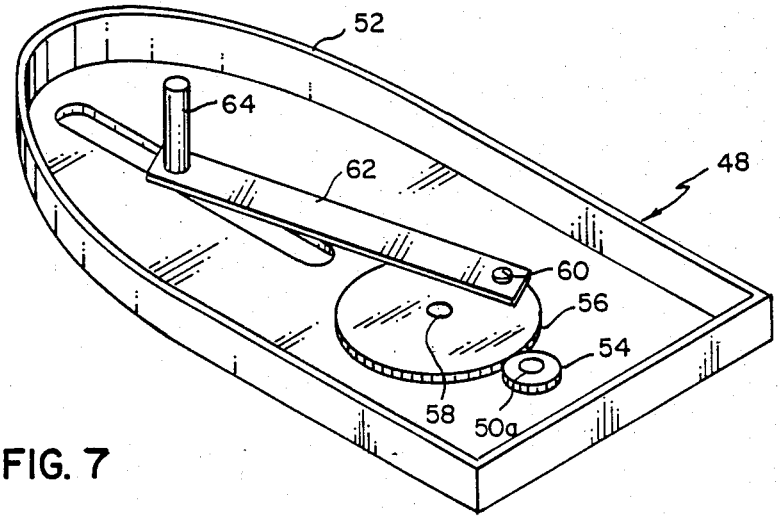
FIG. 7

SHEET ACCUMULATING APPARATUS

This is a continuation of application Ser. No. 943,469, filed Dec. 19, 1986 now abandoned.

BACKGROUND OF THE INVENTION

Field of the Invention

This invention relates in general to sheet handling apparatus, and more particularly to apparatus for accumulating sheets in a stack justified along a marginal edge thereof.

In sheet handling apparatus, it is a common requirement that sheets be accumulated into a stack upon which some subsequent operation, such as stapling or binding, is to be performed. Prior to performing such subsequent operation, it is often desirable that at least one marginal edge of the stack be justified (i.e., all sheets in the stack, along a respective marginal edge, are aligned). Such justification may be done by hand by tamping the stack against a flat surface. This addition of a manual operation is not generally desired and does not always provide for adequate stack edge justification. Alternatively, edge justification may be provided mechanically by structure included with the accumulating apparatus. Mechanical justification is typically accomplished by jogging mechanisms which periodically tamp a marginal edge of the stack against an opposed surface which serves as a registration member. Jogging mechanisms of this type are of a somewhat complicated construction, and must be adjustable if the accumulating apparatus is adapted to accommodate different sheet sizes. Furthermore, since portions of the the jogging mechanisms are located against opposite sides of the sheet stack, it may be necessary to remove at least a portion of such mechanisms to enable the sheet stack to be removed from the accumulating apparatus.

SUMMARY OF THE INVENTION

This invention is directed to an apparatus for receiving sheets traveling seriatem along a path, and accumulating such sheets in in a stack justified along one marginal edge thereof. The apparatus includes a tray into which sheets are directed, one after another, from the sheet travel path for accumulating such sheets into a stack on the tray. A striker plate is associated with one marginal edge of the tray. The accumulated sheets are continuously urged into engagement with the striker plate to justify one margin of the accumulated sheet stack. The mechanism for urging the sheets into engagement with the striker plate is supported relative to the striker plate on the opposite side from the sheet travel path and extending over the tray, and under the influence of gravitational forces follows the level of the topmost sheet in the stack. With such urging mechanism, no adjustment is necessary to accommodate different sheet sizes, and the marginal edges of the accumulated sheet stack (other than the edge against the striker plate) are readily accessible for removal of such stack from the apparatus.

The invention, and its objects and advantages, will become more apparent in the detailed description of the preferred embodiment.

BRIEF DESCRIPTION OF THE DRAWINGS

In the detailed description of the preferred embodiment of the invention presented below, reference is made to the accompanying drawings, in which:

FIG. 7 is a view, in perspective, of the mechanism for moving the accumulating apparatus in a transverse direction relative to the sheet travel path;

FIG. 8 is an end elevational view of the moving mechanism of FIG. 7;

FIG. 9 is side elevational view of a roller assembly for the accumulating apparatus according to this invention.

FIG. 10 is a side elevational view of a guide assembly for the accumulating apparatus according to this invention.

DESCRIPTION OF THE PREFERRED EMBODIMENT

Figure 1:
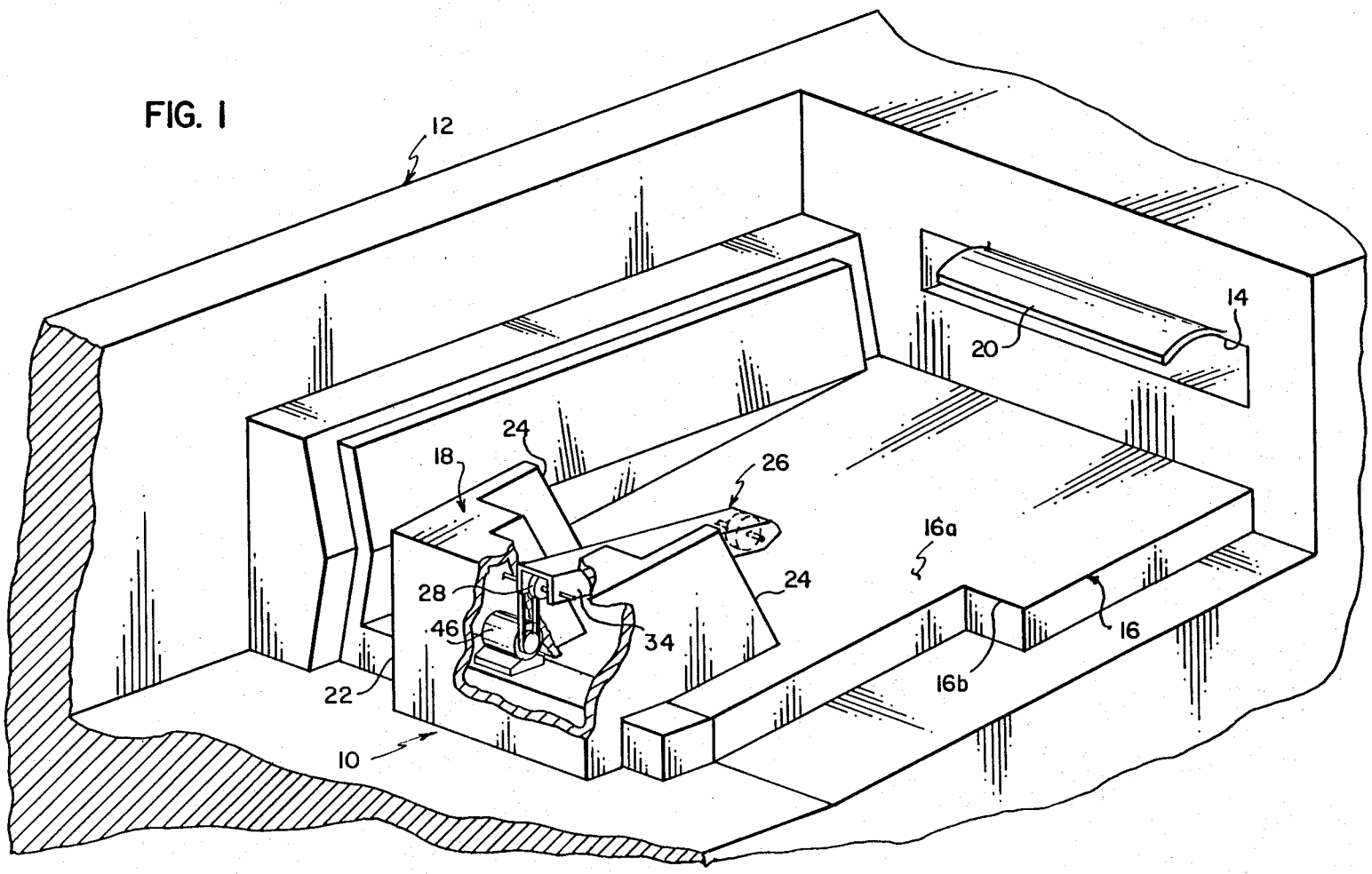
FIG. 1 is a view, in perspective, of the sheet accumulating apparatus according to this invention.
Figure 2:
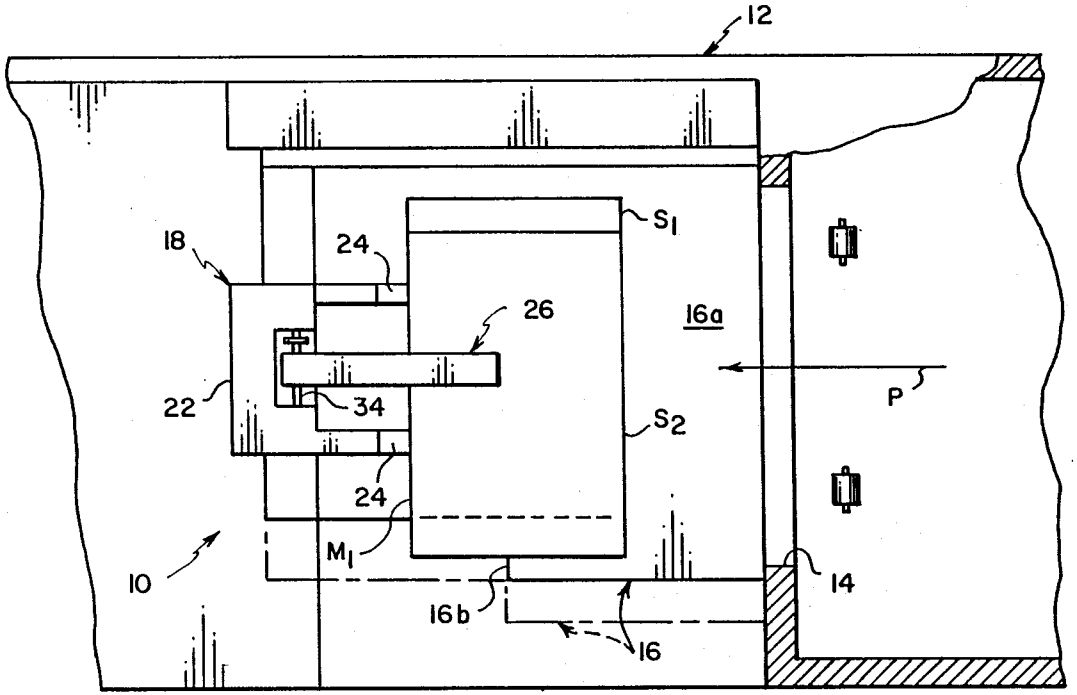
FIG. 2 is a top plan view, partially in cross-section, of the accumulating apparatus of FIG. 1.

Referring now to the accompanying drawings, a sheet accumulating apparatus, according to this invention, is generaly designated by the numeral 10. As best shown in FIGS. 1 and 2, the apparatus 10 is associated with a sheet transport mechanism 12 which includes rollers for feeding sheets seriatem along a path P though a slot 14. The apparatus 10 includes a tray 16, where sheets are accumulated into a stack, and an integral urging assembly 18, for justifying one marginal edge of an accumulated sheet stack. A deflector 20, attached to the mechanism 12 adjacent to the upper edge of the slot 14, directs transported sheets from the path P to the tray 16 of the apparatus 10. The orientation of the deflector 20 is selected such that the directed sheets are received in the tray 16 upstream of the urging assembly 18. This assures that each of the sheets comes under the influence of the urging assembly in the manner explained hereinbelow.

The urging assembly 18 includes a housing 22 having a pair of spaced registration edges 24 extending substantially perpendicular to the surface area **16*a* of the tray 16 on the opposite sides of the center line of the sheet travel path P. The surface 16*a*, upon which the sheets are stacked, is at an angle to the horizontal. Accordingly, gravity acts to urge the sheets exiting the slot 14 and directed to the tray by the deflector 20 toward the edges 24. However, the energy stored in a moving sheet may cause the sheet to rebound from the edges 24, which results in the marginal edge of an accumulated stack being disheveled to an unacceptable extent. Therefore, the assembly 18 includes a mechanism 26 which continuously urges the sheets as they are moving toward the edges 24 into contact with such edges. This results in the marginal edge $M_1$ of the accumulated stack against the edges 24** being justified, with the stack then in a ready condition for any subsequent operation thereon.

Figure 4:
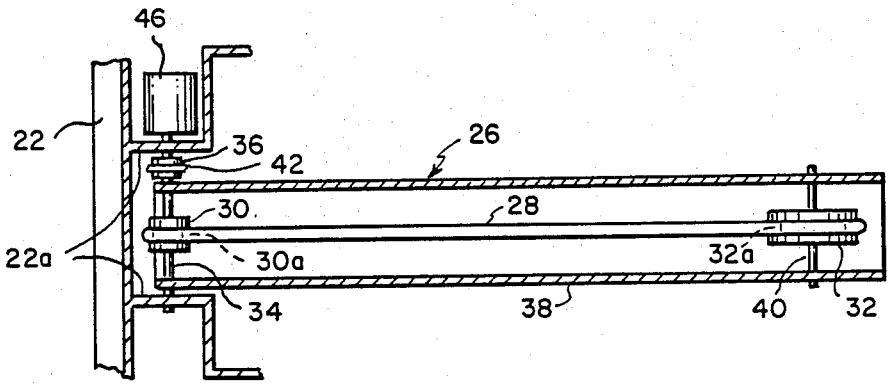
FIG. 4 is a top plan view of the urging mechanism of FIG. 3.
Figure 3:
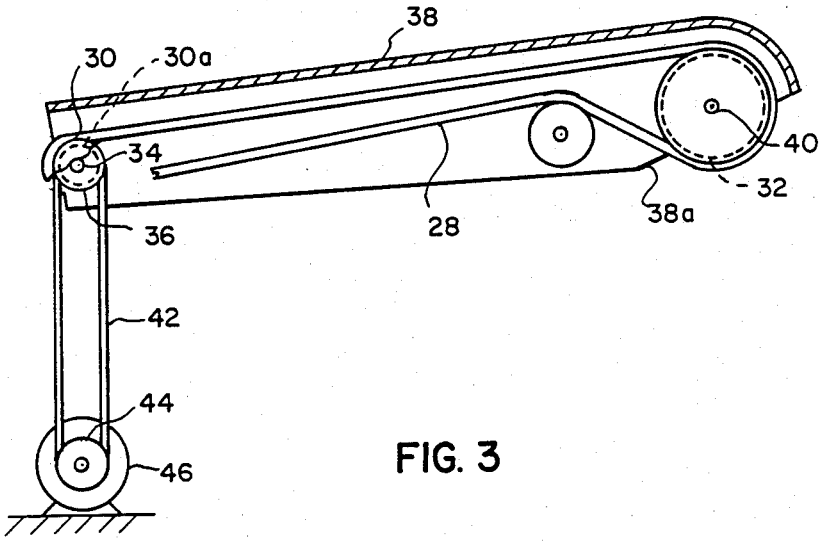
FIG. 3 is a side elevational view, partially in cross-section and on an enlarged scale, of the sheet urging mechanism of the accumulating apparatus of FIG. 1, with portions removed to facilitate viewing.
Figure 5:
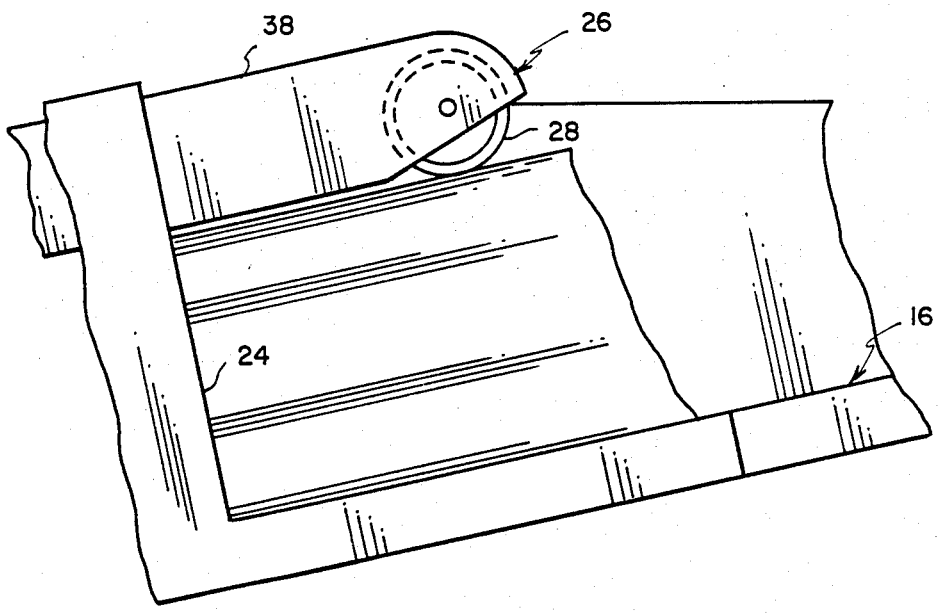
FIGS. 5 and 6 are side elevational views of a portion of the accumulating apparatus and its urging mechanism at different accumulated stack levels.
Figure 6:
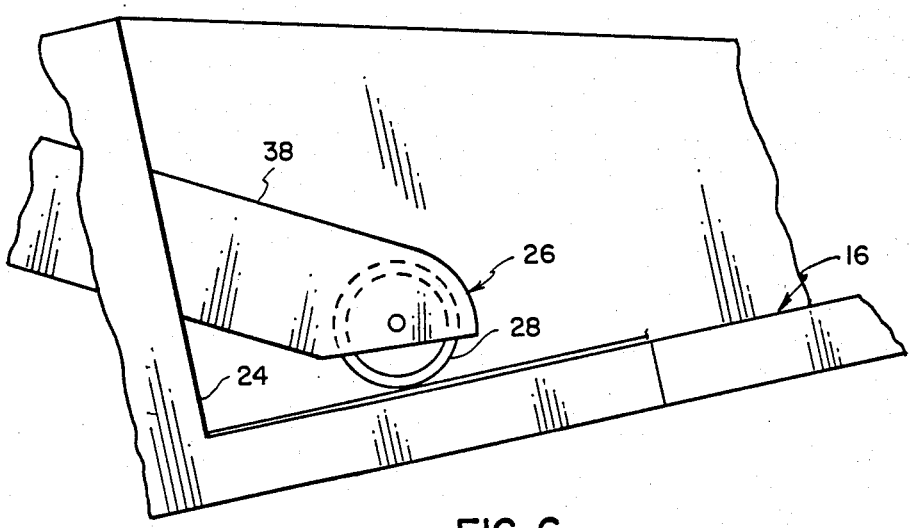

The mechanism 26, as best seen in FIGS. 3 and 4, is a driven scuff belt assembly which includes a friction scuff belt 28 entrained about pulleys 30, 32. Pulley 30 is on a shaft 34 and keyed to such shaft for rotation therewith. The shaft 34 is supported in upstanding walls 22*a* of the housing 22. Further, the shaft 34 also has a pulley 36 mounted on and keyed thereto, and a cantilevered channel-like member 38 mounted for free arcuate movement about such shaft. The member 38 carries a shaft 40 upon which the pulley 32 is mounted for free rotation. A bias cut 38*a* in the member 38, adjacent to the pulley 32, enables the pulley and scuff belt 28 to extend beyond the member 38. Since the belt entrapping grooves 30*a*, 32*a* of the perspective pulleys are relatively shallow when compared to the thickness of the belt 28, the peripheral surface of the belt extends beyond the circumferential periphery of the pulleys. The peripheral surface of the belt 28 is therefore always exposed for contact with the topmost sheet in the accumulated sheet stack. Further, since the member 38, carrying the pulley 32, is movable in an arcuate path about the shaft 34 under the influence of gravitional forces, the exposed surface of the scuff belt is free to follow the level of the accumulated sheets (see FIGS. 5 and 6).

The scuff belt 28 is driven about a closed loop path in a direction which constantly urges a sheet contacted by the scuff belt into registered engagement with the edges 24. In order to effect such scuff belt drive, a drive belt 42 is entrained about the pulley 36 and a pulley 44 fixed on the output shaft of a motor 46. Activation of the motor 46 thus causes the shaft 34 to rotate the pulley 30 and move the scuff belt 28 in the appropriate direction. Since all of the sheets directed to the tray 16 respectively contact the sheet stack already on the tray upstream of the mechanism 26, they are each urged into engagement with the edges 24. Accordingly, the resultant accumulated sheet stack has its marginal edge accurately justified for any subsequent operation on such stack. Further, the tray 16 has a portion 16*b* which is cut back (see FIGS. 1 and 2). The accumulated sheet stack overhangs the cut back portion 16*b* so that it may be easily grasped to enable the stack to be readily removed from the tray.

According to another aspect of this invention, the sheet accumulating apparatus 10 is selectively movable in the direction transverse to the sheet travel path P. Such transverse movement of the apparatus 10 provides for offset stacking of groups of accumulated sheets (see for example stack group $S_1$ and group $S_2$ of FIG. 2). Offset stacking is desirable in certain sheet handling apparatus when it is advantages to separate groups of sheets in a stack. Such group separation is beneficial for example when a stack contains a plurality of repeatable groups of information-containing sheets, such as booklets.

Transverse movement of the sheet accumulating apparatus 10 is effected by an assembly 48 (see FIGS. 7 and 8) located in the transport mechanism 12 beneath the tray 16. The assembly 48 includes a motor 50 coupled to a frame 52. A drive gear 54, fixed to the output shaft 50*a* of the motor 50, is in mesh with a gear 56 supported on an axle 58 carried by the frame 52. A pin 60 carried by the gear 56 is connected to a crank arm 62 adjacent to one end. The opposite end of the crank arm 62 carries an elongated rod 64 which extends substantially perpendicularly from the arm in both directions. The portion 64*a* of the rod engages a slot 66 defined in the frame 52, while the portion 64*b* is received in a boss 68 integrally formed on the bottom of the tray 16. The slot 66 is oriented so that its longitudinal axis lies in a plane which is transverse to the sheet travel path P. Accordingly, when the motor 50 is activated to rotate gear 54 (and thus gear 56), the crank arm 62 is moved to cause reciprocation of the rod 64. Such reciprocation of the rod 64 causes the tray 16 to move in the direction transverse to the sheet travel path. The motor 50 is activated for the length of time required to rotate the gear 56 through an angle of about 180°. This will position the tray 16 in either of two locations (solid line location or phantom line location shown in FIG. 2) spaced in a direction transverse to the sheet travel path. The tray will remain in such position until all the sheets of a desired group are accumulated, and then will be moved to its other position to accumulate sheets of another group. In this manner, offset stack groups are established, with a marginal edge of each stack group being accurately justified. Such stack groups may be readily removed from the tray 16.

In order to facilitate movement of the sheet accumulating apparatus 10 relative to the sheet transport mechanism 12, the apparatus includes a plurality of roller devices 70 (one shown in FIG. 9). The roller devices 70, which are of substantially identical construction, have a support bracket 72 connected to the underside of the tray 16 adjacent to the corners thereof. The support brackets 72 respectively carry an axle 74 upon which a roller 76 is mounted for free rotation. The rollers 76 ride on a surface 12*a* of the transport mechanism 12 so that the apparatus moves easily with respect to the transport mechanism. A post 78, located substantially at the center of the underside of the tray 16, carries a roller 80 which is received in a guide slot 82 defined in the surface 12*a*. The slot 82 is oriented such that its longitudinal axis lies in a plane which is transverse to the sheet travel path P. Accordingly, when the apparatus 10 is moved by the assembly 48, the guide slot confines movement of the roller 80, and thus the apparatus 10 to the desired transverse movement with respect to the sheet travel path P.

The invention has been described in detail with particular reference to preferred embodiment thereof, but it will be understood that variations and modifications can be effected within the spirit and scope of the invention.

We claim:

1. Apparatus for receiving sheets traveling seriatem along a path, and accumulating such sheets in a stack justified along one margin thereof, said apparatus comprising:

a tray in juxtaposition with said sheet travel path;

means for directing sheets from said travel path to said tray one after the other for accumulating such sheets in a stack on said tray;

a striker plate associated with one marginal edge of said tray; and means for continuously urging accumulated sheets on said tray into engagement with said striker plate to justify one margin of such accumulated sheet stack, said urging means, supported on the opposite side of said striker plate from said sheet travel path and extending over said tray to be urged by gravitational forces in a direction to follow the level of the topmost sheet of such accumulated sheet stack, including a pair of pulleys, a belt entrained about said pulleys and having an external surface thereof extending above the peripheral surface of said pulleys, and means for driving one of said pulleys to move said belt about a closed loop path, at least a portion of such closed loop path being in engagement with the topmost sheet of such accumulated sheet stack; and means, located beneath said tray, for selectively moving said tray in a direction transverse to such sheet travel path to relatively offset groups of accumulated sheets.

2. The invention of claim 1 in which said tray moving means includes a crank arm, one end of said crank arm being connected to the bottom of said tray and confined to move in a reciprocating path transverse to the sheet travel path, and the other end of said crank arm being connected to a rotatable member near one edge thereof so that as said rotatable member rotates, said one end of said crank arm is reciprocated to move said tray transverse to such sheet travel path.

* * * * *